US005681690A

United States Patent [19]

Tang et al.

[11] Patent Number: 5,681,690

[45] Date of Patent: Oct. 28, 1997

[54] PHOTOGRAPHIC DYE-FORMING COUPLER, EMULSION LAYER, ELEMENT, AND PROCESS

[75] Inventors: Ping-Wah Tang; Thomas H. Jozefiak, both of Rochester, N.Y.

[73] Assignee: Eastman Kodak Company, Rochester, N.Y.

[21] Appl. No.: 622,768

[22] Filed: Mar. 27, 1996

[51] Int. Cl.[6] ..... G03C 1/09; G03C 7/26; G03C 7/32

[52] U.S. Cl. ..... 430/553; 430/552; 430/385

[58] Field of Search ..... 430/552, 553, 430/385

[56] References Cited

U.S. PATENT DOCUMENTS

| | | | |
|---|---|---|---|
| 4,333,999 | 6/1982 | Lau | 430/17 |
| 4,840,883 | 6/1989 | Masukawa et al. | 430/552 |
| 4,923,791 | 5/1990 | Merkel et al. | 430/553 |
| 5,162,197 | 11/1992 | Aoki et al. | 430/553 |
| 5,378,596 | 1/1995 | Naruse et al. | 430/552 |

FOREIGN PATENT DOCUMENTS

| | | | |
|---|---|---|---|
| 105646 | 6/1984 | Japan . | |
| 0121332 | 7/1984 | Japan | 430/553 |
| 1/206338 | 8/1989 | Japan . | |
| 4/213453 | 6/1992 | Japan . | |
| 4/199148 | 7/1992 | Japan . | |
| 5/142690 | 6/1993 | Japan . | |
| 5/249598 | 9/1993 | Japan . | |

*Primary Examiner*—Geraldine Letscher
*Attorney, Agent, or Firm*—Arthur E. Kluegel

[57] ABSTRACT

The invention provides a photographic light sensitive silver halide emulsion layer having associated therewith a phenolic dye-forming coupler having the formula:

wherein:

$R^1$ and $R^2$ are independently selected from hydrogen and alkyl or aryl groups;

$R^3$ is a substituent group containing β to the carbonyl carbon of the coupler nucleus the group —$S(O)_n$— where n is 0 to 2;

$R^4$ is an aliphatic or aromatic group containing fluoride;

$R^5$ is hydrogen or a substituent group; and

Z is hydrogen or a coupling-off group.

The invention also provides a coupler compound, a photographic element containing the emulsion layer of the invention, and an imaging process.

11 Claims, No Drawings

PHOTOGRAPHIC DYE-FORMING COUPLER, EMULSION LAYER, ELEMENT, AND PROCESS

FIELD OF THE INVENTION

This invention relates to a photographic silver halide emulsion layer containing a phenolic dye-forming coupler which contains a fluoride substituent in the 2-position and a sulfur containing substituent in the 5-position.

BACKGROUND OF THE INVENTION

Silver halide color photography depends on the formation of dyes in order to reproduce an image. These dyes are typically formed from couplers present in or adjacent to the light sensitive silver halide emulsion layers which react to image light upon exposure. During development, the latent image recorded by the silver halide emulsion is developed to amplify the image. During this process in which silver halide is reduced to elemental silver, the color developer compound used is at the same time oxidized, as is typical in a redox reaction. The oxidized developer then reacts or couples with the coupler compound present in or adjacent to the emulsion layer to form a dye of the desired color.

Typically, a silver halide emulsion layer containing a cyan dye-forming coupler is sensitized to red light. This facilitates so-called negative-positive processing in which the image is initially captured in a negative format where black is captured as white, white as black, and the colors as there respective complimentary colors (e.g. green as magenta; blue as yellow; and red as cyan). Then the initial image can be optically printed in the correct colors on a reflective background through the device of optical printing which has the effect of producing a negative of the negative or a positive of the image.

Viewable images may also be produced through reversal processing in which the initial negative image is reversed by using a black and white developer, processed to remove the developed silver, and by then fogging the element in the presence of color developer to provide developed silver in proportion to the amount of image light with corresponding dye formation.

One of the difficulties with color couplers is achieving both a desirable dye forming activity desirable dye hue. In other words, it is necessary for the coupler to be capable of forming sufficient dye density during the development time of the process (e.g. 90 seconds). It is also desirable that the dye formed by reaction between the oxidized color developer and the resulting dye exhibit an absorption curve which has a desired wavelength of maximum absorption and a desired curve shape so as to provide an accurate color rendition.

Couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkupplereine Literature Ubersicht," published in Agfa Mitteilungen, Band III, pp. 156–175 (1961). One type of commonly employed cyan dye-forming coupler is based on the phenol group. Such couplers are taught that have a carbonamido substituent in the 2-position and in the 5-position of the phenol.

Examples of such couplers are shown in the above mentioned U.S. Pat. No. 4,333,999, and in U.S. Pat. No. 4,923,791. While such couplers have been considered useful for use in photographic layers, they are deficient due to their relatively low activity and due to the shortcomings in the absorption curve of the resulting dyes.

A dye having improved activity and thus increased dye density allows the use of lower amounts of coupler. This enables the use of a thinner layer which not only reduces the raw material costs but also improves the quality of the resulting image since thinner layers improve sharpness due to the reduction in the degree of light scatter that occurs. An improved absorption curve provides better color rendition and may reduce the need for the use of masking couplers or other color correction devices.

It is therefore a problem to be solved to provide a photographic silver halide emulsion layer which will exhibit the desired dye forming ability and will also provide an improved light absorption curve.

SUMMARY OF THE INVENTION

The invention provides a photographic light sensitive silver halide emulsion layer having associated therewith a phenolic dye-forming coupler having the formula:

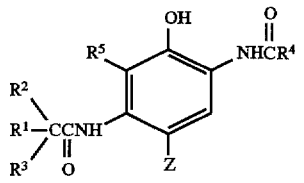

wherein :

$R^1$ and $R^2$ are independently selected from hydrogen and alkyl or aryl groups;

$R^3$ is a substituent group containing β to the carbonyl carbon of the coupler nucleus the group —$S(O)_n$— where n is 0 to 2;

$R^4$ is an aliphatic or aromatic group containing fluoride;

$R^5$ is hydrogen or a substituent group; and

Z is hydrogen or a coupling-off group.

The invention also provides a coupler compound, a photographic element containing the emulsion layer of the invention, and an imaging process.

The invention provides a photographic silver halide emulsion layer containing a cyan dye forming coupler which exhibits the desired dye forming ability and which also exhibits an improved light absorption curve.

DETAILED DESCRIPTION OF THE INVENTION

The coupler of the invention has the general formula as described in the Summary of the Invention. In the formula for the coupler of the invention, $R^1$ and $R^2$ are independently selected from hydrogen and alkyl or aryl groups. Suitably, such groups may have from 1 to 15 carbon atoms with 2 to 12 carbon atoms being typical. In one embodiment, the groups are hydrogen or alkyl groups containing from 2 to 8 carbon atoms. Examples of suitable groups include methyl, ethyl, cyclopropyl, isopropyl, butyl, t-butyl, cyclopentyl, cyclohexyl, t-octyl, adamantyl, and dodecyl.

$R^3$ is a substituent comprising the group —$S(O)_n$ where n is 0 to 2. Thus the substituent may contain a thio, suloxy, or sulfone group. Typically, the group may be —$SR^6$, —$SOR^6$, or —$SO_2R^6$ where $R^6$ is an alkyl or aryl group. Typically $R^6$ contains up to 18 carbon atoms and may be exemplified by dodecyl, hexadecyl, octadecyl, phenyl, tolyl, or p-ethylphenyl. The sulfoxy and sulfone are desirably employed with the sulfone being preferred. The sulfur containing group is suitably located so as to be the portion of $R^3$ bonded to the rest of the molecule.

It is convenient for the coupler molecule to be ballasted by means of a component of $R^3$. As discussed hereafter, ballasting is the inclusion in the coupler of sufficient lipophilic components so as to render the coupler substantially non-diffusible in an aqueous alkaline developing bath. Where it is desired to ballast using $R^3$, alkyl groups of 6 or more, preferrably 8 or more carbon atoms are typically employed.

The substituent $R^4$ of the inventive coupler is an aliphatic or aromatic group which contains one or more fluorine atoms. The perfluorinated alkyl and aromatic compounds are most suitable. Examples of suitable fluorinated groups include heptafluoropropyl, nonafluorobutyl, pentadecylfluoroheptyl, 3,4-difluorophenyl, 1,3,5-trifluorophenyl, and pentafluorophenyl.

Z in the formula is hydrogen or a coupling-off group. Any coupling-off group such as halogen, heterocyclic, alkylthio, arylthio, or aryloxy may be employed. Most suitable are hydrogen, aryloxy and hydrogen. In particular, useful are chloride and substituted aryloxy. Examples include phenoxy, p-methoxyphenoxy, and chloro.

Specific examples of couplers useful in the invention are:

CC-1

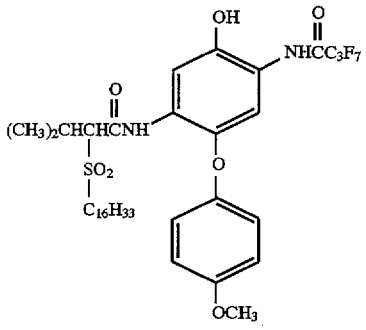

CC-2

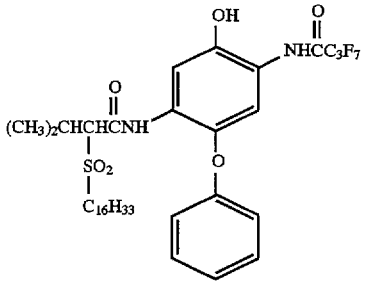

CC-3

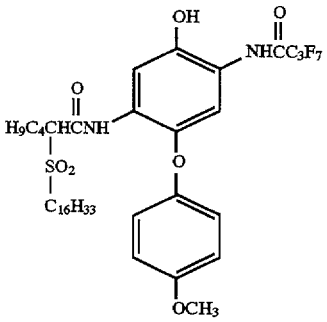

-continued

CC-4

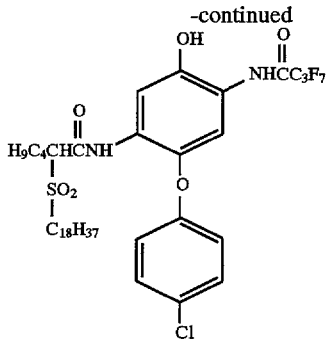

CC-5

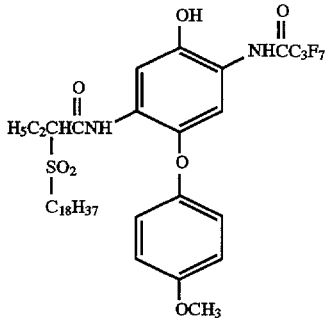

CC-7

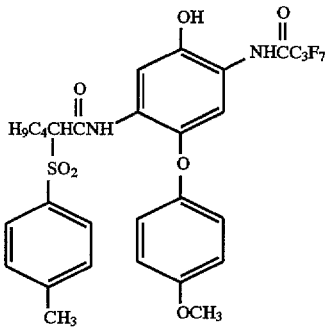

CC-9

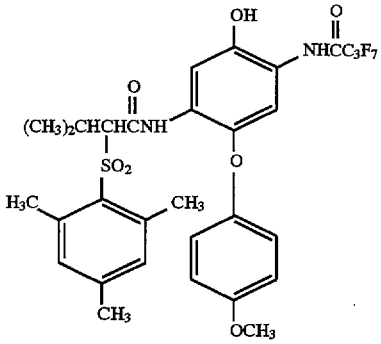

CC-10

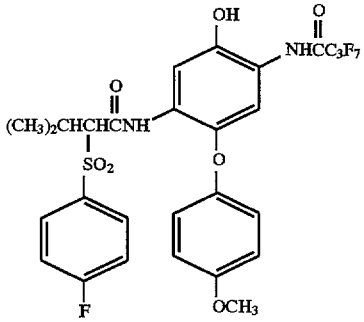

-continued
CC-11
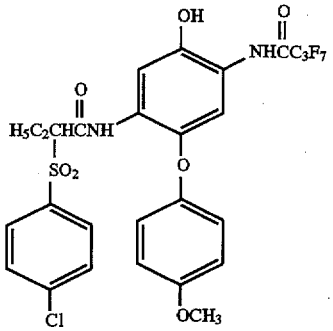
CC-12
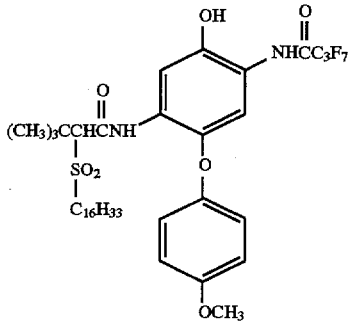
CC-13
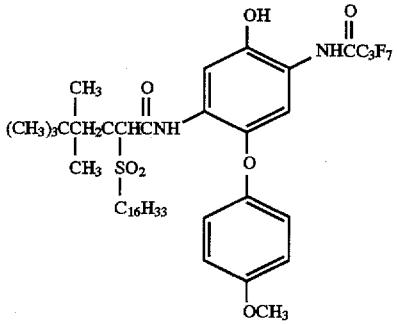
CC-14
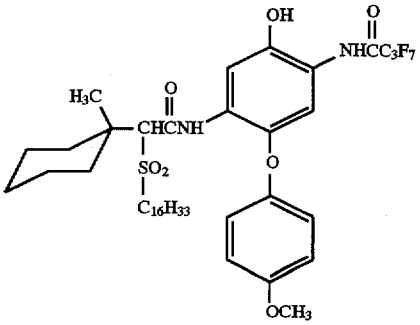
CC-15
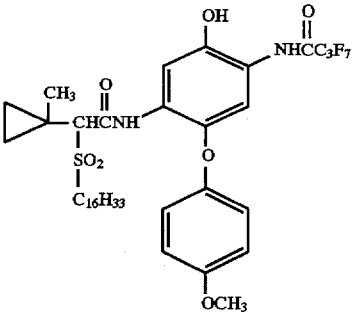
-continued
CC-16
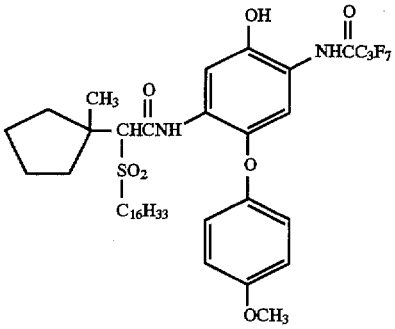
CC-17
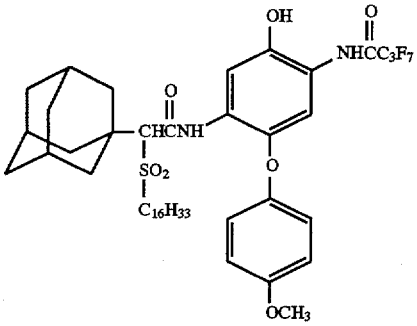
CC-18
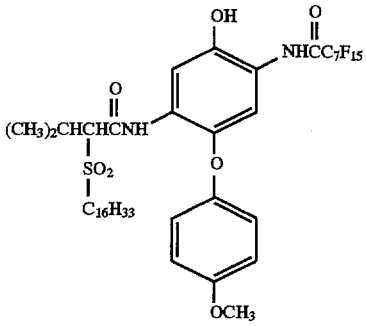
CC-19
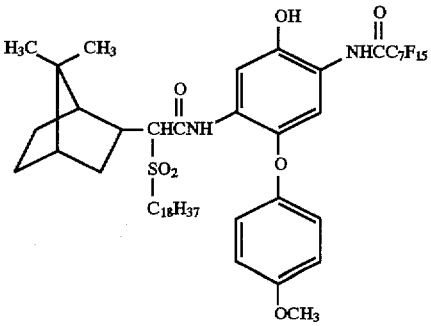
CC-20
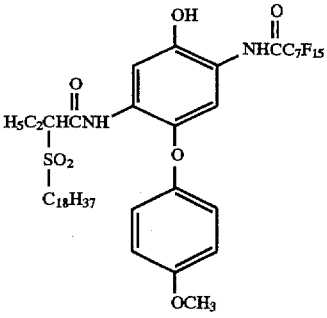

-continued
CC-22
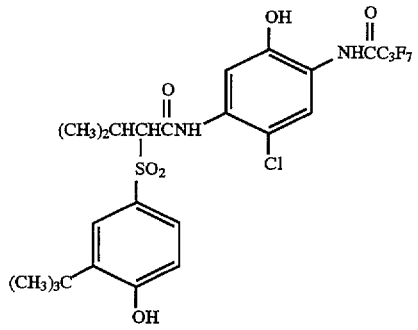
CC-23
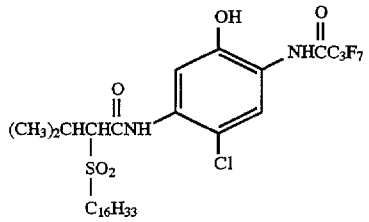
CC-24
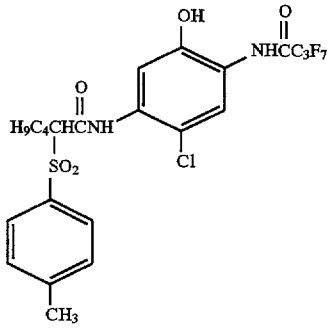
CC-25
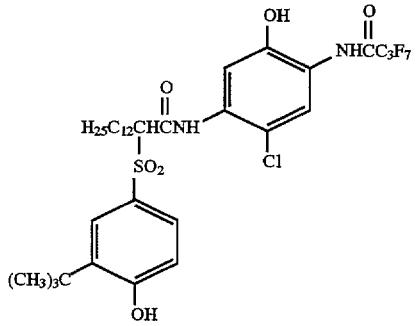
CC-26
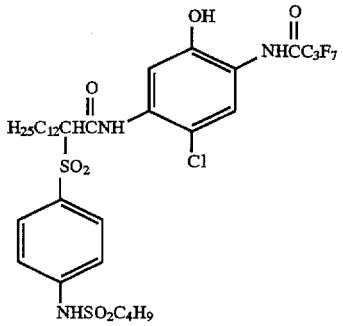
-continued
CC-27
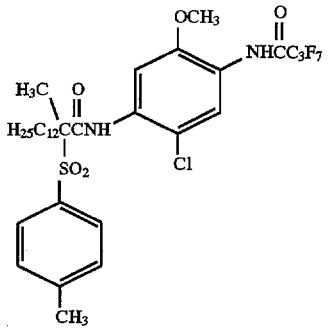
CC-28
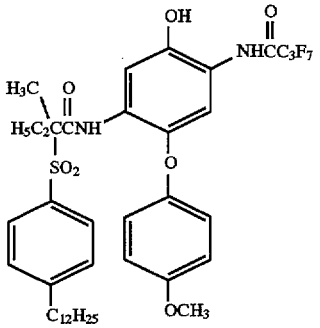
CC-29
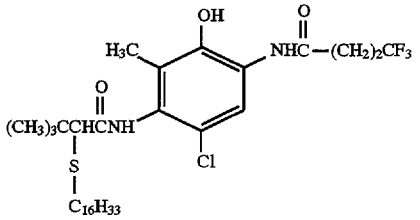
CC-30
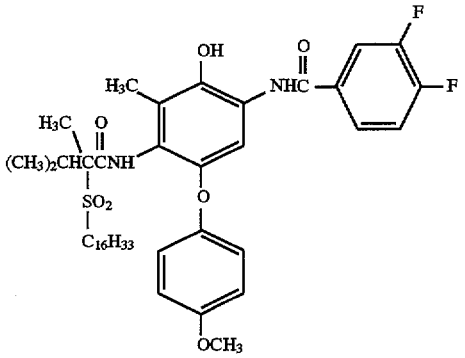
CC-31
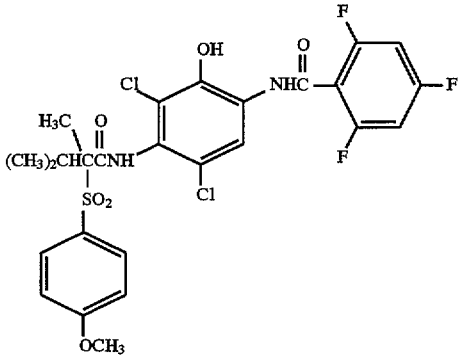

-continued

CC-32

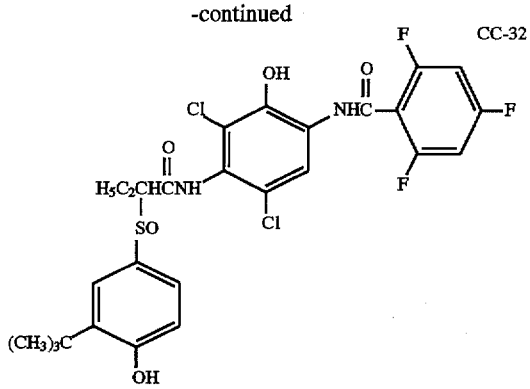

CC-33

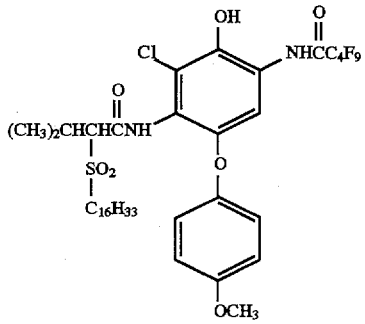

CC-34

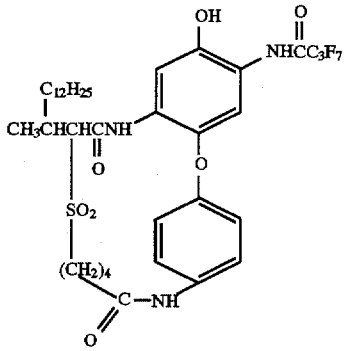

CC-35

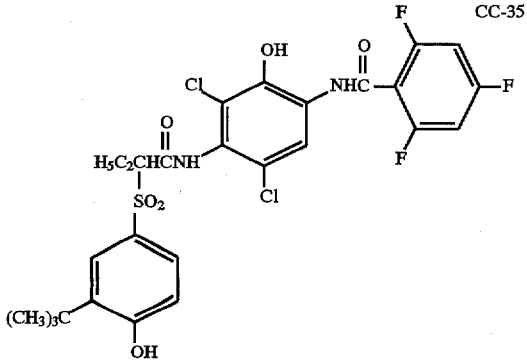

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha-or beta-naphthyloxy, and 4-tolyloxy; carbonamido, such as acetamido, benzamido, butyramido, tetradecanamido, alpha-(2,4-di-t-pentylphenoxy) acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3 -dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkupplereine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkupplereine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Bart, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

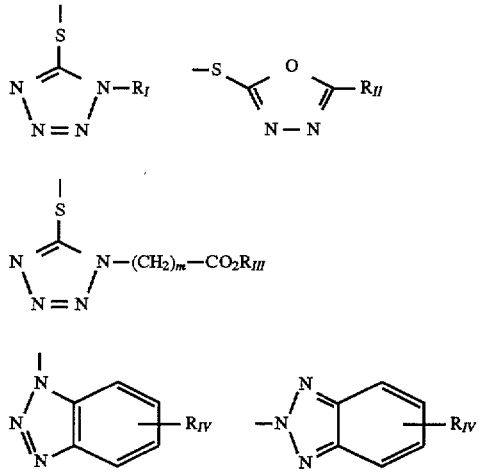

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

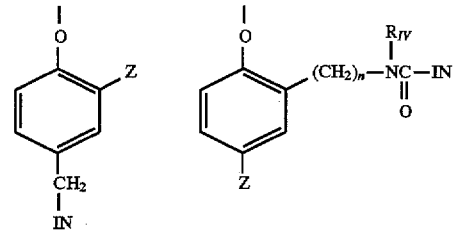

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

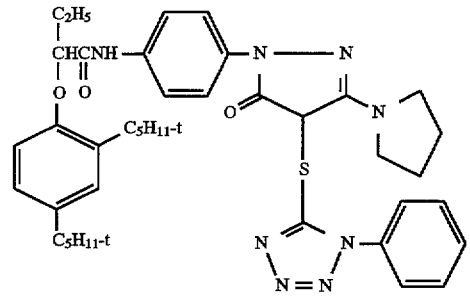

D2

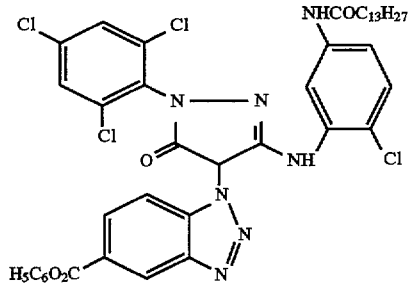

D3

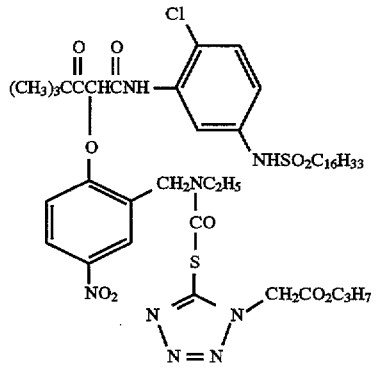

-continued
D4
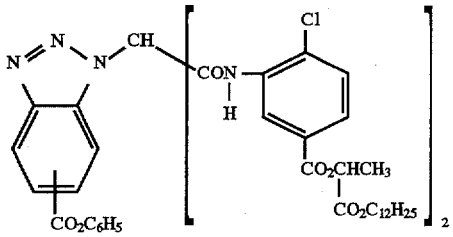
D5
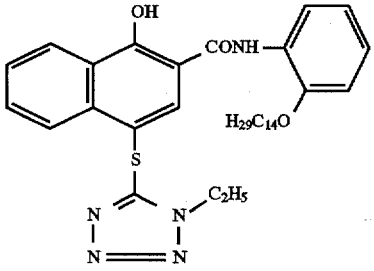
D6
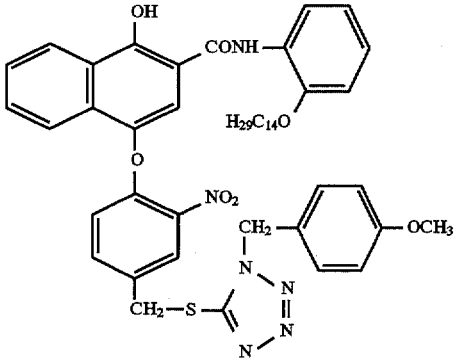
D7
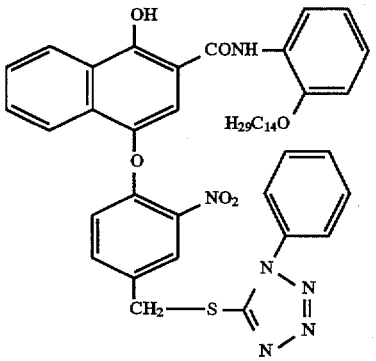
D8
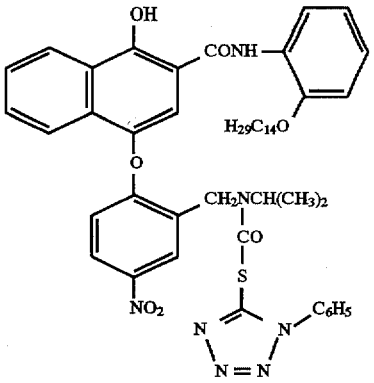
-continued
D9
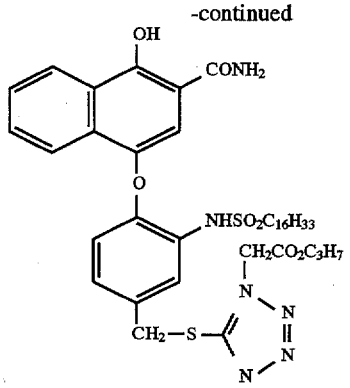
D10
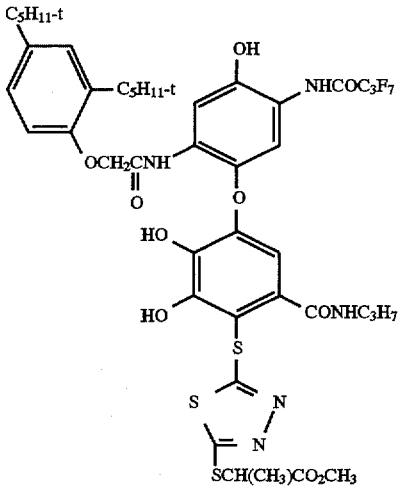
D11
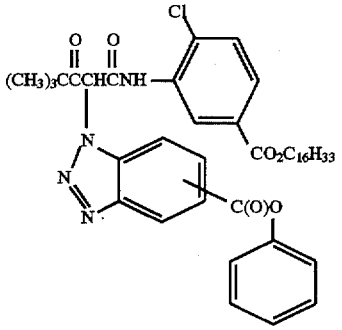
D12
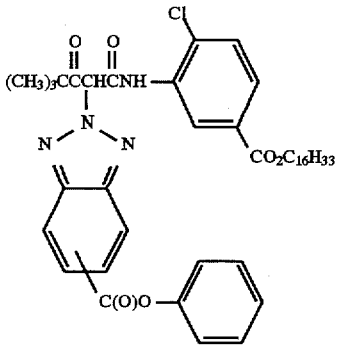
It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference.

Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3 -(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The couplers of the invention may be prepared in accordance with the following general scheme:

Synthetic Scheme

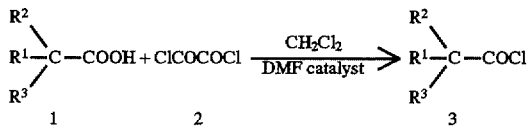

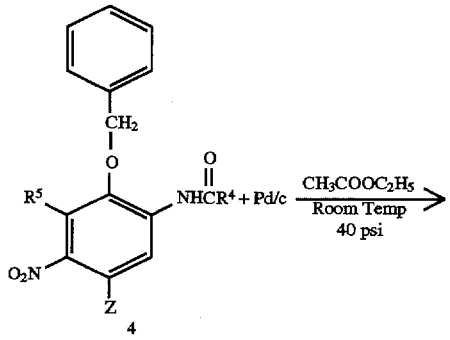

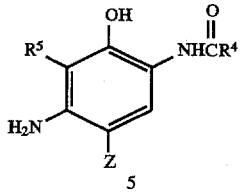

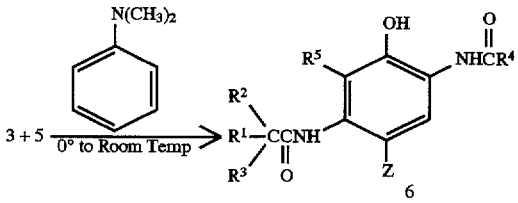

Synthetic Example

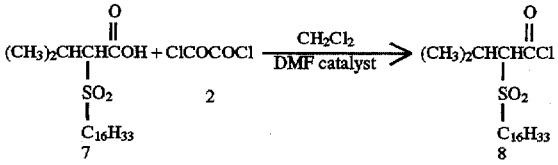

-continued

Synthetic Example

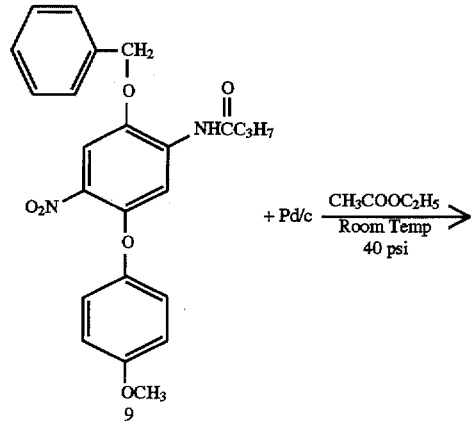

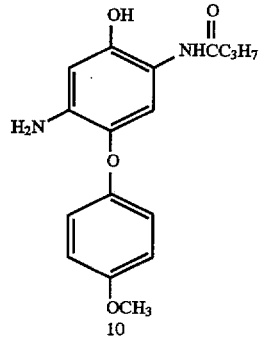

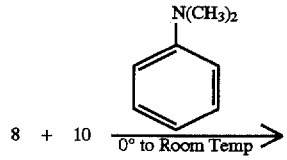

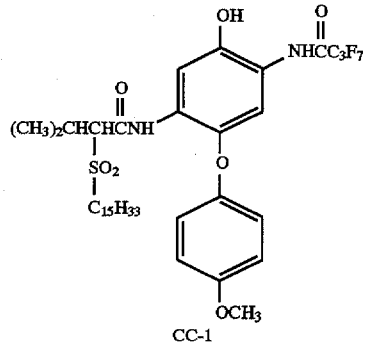

Preparation of 2-hexadecylsulfonyl-3-methyl butanoyl chloride 8

To a solution of 4 g (10.23 mmol) of 2-hexadecylsulfonyl-3-methyl butanoic acid in 35 mL of dichloromethane at RT was added 4 drops of DMF, followed by the addition of 4 mL of oxalyl chloride. The resulting solution was stirred at RT for 3 h and ½ h at 35° C. The solution was concentrated in vacuo to yield an oil. 35 mL of pentane was added to the oil. The mixture was concentrated in vacuo. The resulting acid chloride was kept in vacuo for the use in the next step.

B. Reduction reaction: Preparation of 5-amino-2-(2,2,3,3,4,4-heptafluoro-butanamido)-4-(4-methoxy phenoxy)phenol 10

In a high pressure reaction reactor was dissolved 5.63 g (10 mmol) of 2-(2,2,3,3,4,4-heptafluorobutanamido-4-(4-methoxyphenol) -5-nitro-0-benzylphenol g in 35 mL of ethyl acetate, followed by the addition of a catalytic amount of 10% Pd/C. The nitro-compound was subjected to the reduction under 50 PSI of hydrogen pressure. TLC indicated the complete reduction (system: $CH_3COOC_2H_5$/ligroin: 2/1). The thus formed amino-compound in the reactor was subjected to the reaction with acid chloride 8 without isolation.

C. Preparation of cyan coupler CC-1: N-(4-(2,2,3,3,4,4-heptafluoro-butanamido) -5-hydroxy-2-(4-methoxy phenoxy)phenyl-2-hexadecylsulfonyl-3-methyl butanamide To a stirred reaction mixture the coupler amine 10 under nitrogen was added 1.33 g (11 mmol) of N,N-dimethylaniline followed by the addition of the acid chloride 8 in 12 mL of dried THF. After the addition, the reaction was stirred at RT for 18 h. The reaction was filtered over celite and the filtrate was concentrated in vacuo to about 20 mL in volume. It was poured into a mixture of water and ice containing 7 mL of concentrated HCl acid. The resulting gummy product was stirred at RT for 3 hr. The supernatant liquid was decanted and fresh water was added, followed by the vigorous stirred. This procedure was repeated three times. It was stirred overnight. The crystalline solid was collected by filtration, washed and dried in vacuo. It was further purified by slurrying in heptane for 2 h. The solid was collected and dried. TLC showed one spot material. The weight was 7.2 g(88%). All analytical data confirmed the assigned structure of CC-1.

Photographic Examples

Preparation of the Photographic Elements

Dispersions of the couplers were prepared in the following manner. In one vessel, coupler CC-1 (1.113 g), coupler solvent (dibutylphthalate, 0.566 g), and ethyl acetate (3.40 g) were combined and warmed to dissolve. In a second vessel, gelatin (2.29 g), Alkanol XC™ (E. I. duPont Co.) (2.29 g) and water (31.7 g) were combined and passed three times through a Gaulin colloid mill. The ethyl acetate was removed by evaporation. The resulting dispersion was mixed with water, and the required amount of a red sensitive AgCl emulsion (containing a known amount of gelatin) to produce a coating melt with a gel content of 2.0%. This melt was then coated as the chromogenic layer as described below.

The photographic elements were prepared by coating the following layers in the order listed on a resin-coated paper support:

| | |
|---|---|
| 1st layer | |
| Gelatin | 27.9 mg/m$^2$ |
| 2nd layer | |
| Gelatin | 13.9 mg/m$^2$ |
| Coupler | 0.74E − 5 mol/m$^2$ |
| Coupler solvent dibutylphthalate | equivalent to ½ coupler weight |
| Red sensitized AgCl emulsion | 3.35 mg Ag/m$^2$ (4-eq coupler) 1.68 mg Ag/m$^2$ (2-eq coupler) |
| 3rd layer | |
| Gelatin | 11.52 mg/m$^2$ |
| 2-(2H-benzotriazol-2-yl)-4,6-bis-(1,1-dimethylpropyl)phenol | 6.32 mg/m$^2$ |
| Tinuvin 326™ (Ciba-Geigy) | 1.12 mg/m$^2$ |
| 4th layer | |
| Gelatin | 12.08 mg/m$^2$ |
| Bis(vinylsulfonylmethyl)ether | 1.17 mg/m$^2$ |

Exposure and Processing of Photographic Elements

The photographic elements were given stepwise exposures to red light and processed as follows at 35° C.:

| | |
|---|---|
| Developer | 45 seconds |
| Bleach-Fix | 45 seconds |
| Wash (running water) | 1 minute, 30 seconds |

The developer and bleach-fix were of the following compositions:

| | |
|---|---|
| Developer | |
| Water | 700.00 mL |
| Triethanolamine | 12.41 g |
| Blankophor REU™ (Mobay Corp.) | 2.30 g |
| Lithium polystyrene sulfonate (30%) | 0.30 g |
| N,N-Diethylhydroxylamine (85%) | 5.40 g |
| Lithium sulfate | 2.70 g |
| N-{2-[4-amino-3-methylphenyl) ethylamino]ethyl}methanesulfonamide sesquisulfate | 5.00 g |
| 1-Hydrocyethyl-1,1-diphosphonic acid (60%) | 0.81 g |
| Potassium carbonate, anhydrous | 21.16 g |
| Potassium chloride | 1.60 g |
| Potassium bromide | 0.007 g |
| Water to make | 1.00 L |
| pH @ 26.7° C. adjusted to 10.04 +/− 0.05 | |
| Bleach Fix | |
| Water | 700.00 mL |
| Solution of ammonium thiosulfate (54.4%) + ammonium sulfite (4%) | 127.40 g |
| Sodium metabisulfite | 10.00 g |
| Acetic acid (glacial) | 10.20 g |
| Solution of ammonium ferric ethylenediaminetetraacetate (44%) + ethylenediaminetetraacetic acid (3.5%) | 110.40 g |
| Water to make | 1.00 L |
| pH @ 26.7° C. adjusted to 5.50 +/− 0.10 | |

Photographic Tests

Cyan dye was formed upon processing. The following photographic characteristics were determined: Dmax (the maximum density to red light); Dmin (the minimum density to blue light); Speed (the relative log exposure required to yield a density to red light of 1.0); and Contrast (the ratio (S–T)/0.6, where S is the density at a log exposure 0.3 units greater than the Speed value and T is the density at a log exposure 0.3 units less than the Speed value). Visible reflectance spectra of a set of exposed and processed strips were measured at a dye density that gave an absorbance near 1.0 at the peak maximum. The spectra were measured from 360 nm to 800 nm on a Hitachi 3410 scanning spectrophotometer using 0/45 reflectance geometry.

The following comparison couplers were employed:

C-1

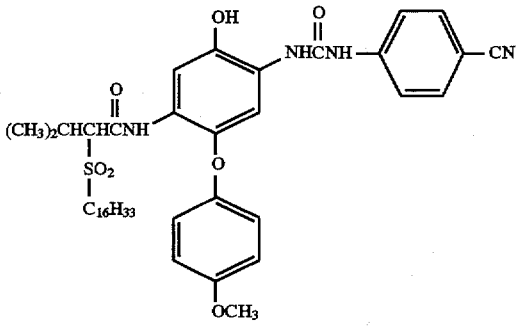

C-2

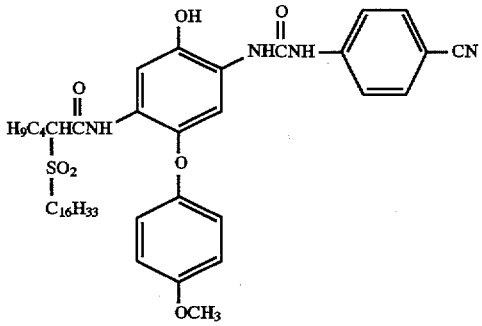

C-3

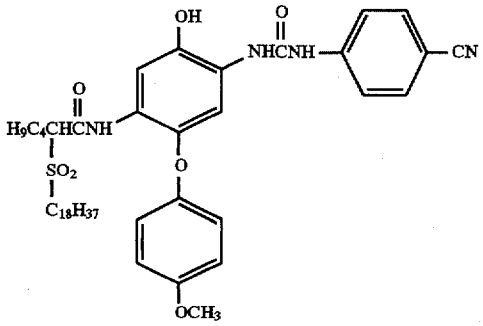

-continued

C-4

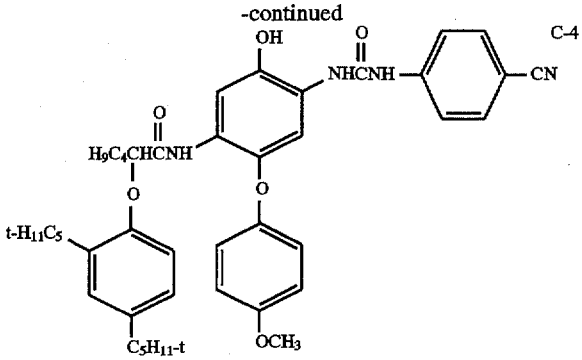

C-5

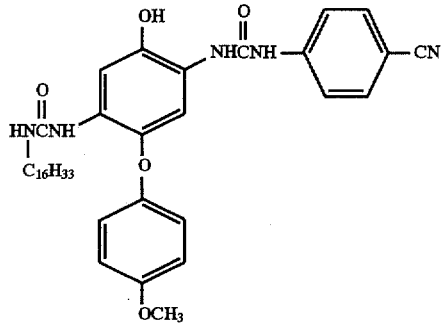

C-6

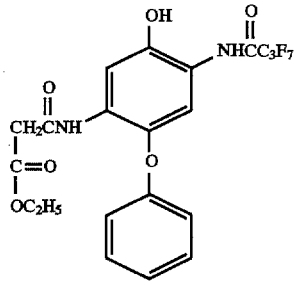

Table I describes the coupler substituents present in the various inventive and comparative couplers tested, indicating whether the substituents $R^3$ and $R^4$ are within the limitations of the invention.

TABLE I

SAMPLE TYPES

| COUPLER | TYPE | WITHIN INVENTION? Yes (Y) or No (N) $R^3$ | $R^4$ |
|---|---|---|---|
| CC-1 | Inv | Y | Y |
| CC-2 | Inv | Y | Y |
| C-1 | Comp | Y | N |
| C-2 | Comp | Y | N |
| C-3 | Comp | Y | N |
| C-4 | Comp | N | N |
| C-5 | Comp | N | N |
| C-6 | Comp | N | Y |

Table II shows the results of subjecting the described samples to the tests described earlier.

TABLE II

RESULTS OF TESTING

| COUPLER | TYPE | Dmax | CONTRAST | SPEED | λmax (nm) | Unwanted Blue Density | Bandwidth (nm) |
|---|---|---|---|---|---|---|---|
| CC-1 | Inv | 2.64 | 2.62 | 130 | 657 | 0.048 | 188.5 |
| C-1 | Comp | 2.02 | 1.73 | 108 | 693 | 0.093 | 192.3 |
| C-2 | Comp | 2.48 | 2.09 | 116 | 676 | 0.066 | 191.8 |
| C-3 | Comp | 2.51 | 2.12 | 115 | 675 | 0.060 | 193.3 |
| C-4 | Comp | 1.89 | 1.56 | 105 | 683 | 0.053 | 197.9 |
| C-5 | Comp | 2.29 | 2.08 | 126 | 683 | 0.090 | 194.1 |

It is apparent from the Table II that the inventive coupler is more active (as measured by Dmax, contrast, and speed), and has a more desirable absorption curve (lower wavelength of maximum absorption, narrower bandwidth, and less unwanted blue absorption).

The results of another test are set forth in Table III.

TABLE III

RESULTS OF TESTING

| COUPLER | TYPE | Dmax | CONTRAST | SPEED | λmax (nm) |
|---|---|---|---|---|---|
| CC-2 | Inv | 2.77 | 2.87 | 131 | 661 |
| C-6 | Comp | 0.70 | <1 | <50 | 651 |

The results of Table III show that when the $R^4$ substituent is selected in accordance with the invention but not $R^3$, very poor activity of the coupler is observed making it impractical for processing within the allowable processing times.

The entire contents of the various patent applications, patents and other publications referred to in this specification are incorporated herein by reference.

What is claimed is:

1. A photographic reflective print element comprising a light sensitive silver chloride emulsion layer having associated therewith a phenolic dye-forming coupler having the formula:

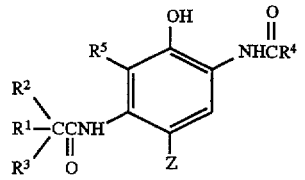

wherein:

$R^1$ and $R^2$ are independently selected from hydrogen and alkyl or aryl groups;

$R^3$ is a substituent group containing β to the carbonyl carbon of the coupler nucleus the group $—S(O)_n—$ where n is 1 or 2;

$R^4$ is a perfluorinated alkyl group;

$R^5$ is hydrogen; and

Z is an aryloxy group.

2. The layer of claim 1 wherein $R^4$ is a perfluorinated alkyl group of up to 9 carbon atoms.

3. The element of claim 1 wherein $R^4$ is a heptafluorylpropyl or pentadecylfluoroheptyl group.

4. The element of claim 1 wherein $R^3$ contains a $—S(O)_n—$ group where n is 2.

5. The element of claim 1 wherein $R^3$ has the formula $—SO_2—R^6$ where $R^6$ is an alkyl or aryl group.

6. The element of claim 1 wherein $R^3$ together with $R^1$ and $R^2$ contain lipophilic groups of a nature and number sufficient to render the coupler substantially nondiffusible in an aqueous alkaline developing bath.

7. The element of claim 6 wherein $R^3$ contains 6 or more carbon atoms.

8. The element of claim 1 wherein the $R^3$ group bonds back to the nucleus of the coupler to form a ring.

9. The element of claim 1 wherein $R^1$ is an alkyl group.

10. The element of claim 1 wherein the nature, number and size of the substituent groups $R^1$ through $R^5$ are sufficient to render the coupler nondiffusible during aqueous alkaline development processing of the element.

11. A method of forming an image in an element as described in claim 1 after the element has been imagewise exposed to light, comprising contacting the element with a color developing agent.

* * * * *